US007980101B2

(12) United States Patent
Son et al.

(10) Patent No.: US 7,980,101 B2
(45) Date of Patent: Jul. 19, 2011

(54) LAUNDRY DRYER WITH A STEAM GENERATOR AND METHOD OF CONTROLLING THE SAME

(75) Inventors: Chang Woo Son, Changwon-si (KR); Sang Hun Bae, Changwon-si (KR); Chul Jin Choi, Changwon-si (KR); Dong Hyun Kim, Changwon-si (KR); Young Bok Son, Changwon-si (KR); Heung Jae Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 754 days.

(21) Appl. No.: 11/980,777

(22) Filed: Oct. 31, 2007

(65) Prior Publication Data

US 2008/0141734 A1 Jun. 19, 2008

(30) Foreign Application Priority Data

Dec. 14, 2006 (KR) ..... 10-2006-0127590

(51) Int. Cl.
*B08B 3/12* (2006.01)
*D06B 19/00* (2006.01)
*D06F 35/00* (2006.01)

(52) U.S. Cl. ..... 68/5 C; 68/5 R; 8/149.3; 8/158

(58) Field of Classification Search ..... 68/5 C, 68/5 R; 8/158, 149.3
See application file for complete search history.

(56) References Cited

U.S. PATENT DOCUMENTS

| | | | | |
|---|---|---|---|---|
| 3,662,276 | A * | 5/1972 | Hyer | 330/1 A |
| 5,228,212 | A * | 7/1993 | Turetta et al. | 34/493 |
| 6,566,855 | B1 * | 5/2003 | Nguyen et al. | 324/117 R |
| 2004/0099287 | A1 * | 5/2004 | Shin | 134/18 |
| 2005/0034489 | A1 * | 2/2005 | Oh et al. | 68/5 C |
| 2005/0115120 | A1 * | 6/2005 | Cevik | 38/14 |
| 2006/0011071 | A1 * | 1/2006 | Cho et al. | 99/417 |
| 2006/0277690 | A1 * | 12/2006 | Pyo et al. | 8/149.2 |
| 2008/0040867 | A1 * | 2/2008 | Wong et al. | 8/149.3 |

FOREIGN PATENT DOCUMENTS

| | | | |
|---|---|---|---|
| EP | 276458 | A2 * | 8/1988 |
| JP | 10323497 | A * | 12/1998 |
| WO | WO 2006101376 | A1 * | 9/2006 |

* cited by examiner

*Primary Examiner* — Michael Barr
*Assistant Examiner* — Charles W Kling
(74) *Attorney, Agent, or Firm* — McKenna Long & Aldridge LLP

(57) ABSTRACT

A laundry machine including a selectively rotatable drum, a pump for supplying water to a steam generator, and a controller for determining if the pump is out of order. This determination is made by monitoring either a time period required for supplying water to a preset water level of the steam generator or electric current drawn by the pump.

18 Claims, 12 Drawing Sheets

LAUNDRY DRYER WITH A STEAM GENERATOR AND METHOD OF CONTROLLING THE SAME

This application claims the benefit of the Korean Patent Application No. 10-2006-0127590, filed on Dec. 14, 2006, which is hereby incorporated by reference in its entirety as if fully set forth herein.

BACKGROUND OF THE INVENTION

1. Field of the Invention

The present invention relates to a laundry machine, and more particularly, to a laundry machine having a steam generator provided thereto for preventing creases from forming on clothes and sterilizing the clothes, and a method for controlling the same.

2. Discussion of the Related Art

In general, laundry dryers are electric appliances that dry washed laundry, mainly washed clothes, by using high temperature air.

In general, the laundry dryer is provided with a drum, a driving source for driving the drum, heating means for heating air introduced to the drum, and a blower unit for drawing/discharging air from/to the drum.

In the dryers, there are electric type dryers and gas type dryers depending on air heating systems, i.e., the heating means. The electric type dryers heat the air with heat from electric resistance, and the gas type dryers heat the air with heat from combustion of gas.

The dryers may also be sorted as condensing type dryers and exhaust type dryers. In the condensing type dryer, the humid air having heat exchanged with an drying object in the drum is, not discharged to an outside of the dryer, but circulated in the dryer, and heat exchanged with external air at a condenser provided separately to form condensed water which is discharged to an outside of the dryer. In the exhaust type dryer, the humid air having heat exchanged with the drying object in the drum is discharged to an outside of the dryer, directly.

The dryers may also be sorted as top loading type dryers, and front loading type dryers depending on systems for introducing the drying object to the dryers. In the top loading type dryers, the drying object is introduced to the dryer from a top thereof, and in the front loading type dryers, the drying object is introduced to the dryer from a front thereof.

However, the related art dryers have the following problems.

In general, the related art dryer dries laundry washed, spun, and introduced thereto. However, in view of nature of washing with water, creases are formed on the washed laundry, and the creases formed thus are not removed perfectly in drying with the dryer. Therefore, in order to remove the creases from a drying object, such as the laundry dried at the related art dryer, pressing is required, additionally.

Moreover, besides the washed laundry, in cases of conventional storage, and use of clothes, creases, crumples, and folds (will be called as crumples, collectively) are formed on the clothes. Development of an appliance has been required, which can make easy removal of the crumples coming from the conventional storage and use of the clothes.

SUMMARY OF THE INVENTION

Accordingly, the present invention is directed to a laundry machine with a steam generator for preventing creases from forming on laundry, and sterilizing the laundry.

An object of the present invention is to provide a laundry machine with a safety device for determining a water supply line to a steam generator of being out of order and protecting a steam generator system, and a method for controlling the same.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a laundry machine includes a selectively rotatable drum, and controller for determining the pump of being out of order by using a time period required for supplying water to a preset water level of the steam generator or a current to the pump.

In another aspect of the present invention, a method for controlling a laundry machine includes the steps of (a) operating a pump for supplying water from a water supply source to a steam generator, and (b) determining the pump of being out of order by using a time period required for supplying water to the steam generator at a preset water level thereof or a current to the pump.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

In order to describe a laundry machine and a method for controlling the same of the present invention, a top loading, electric, and exhaust type dryer will be taken as an embodiment for the sake of convenience. Of course, however, the present invention is not limited to this, but the present invention is, not only applicable to front loading type, gas type, and condensing type dryers, but also to various kinds of washing machines.

Figure 1:
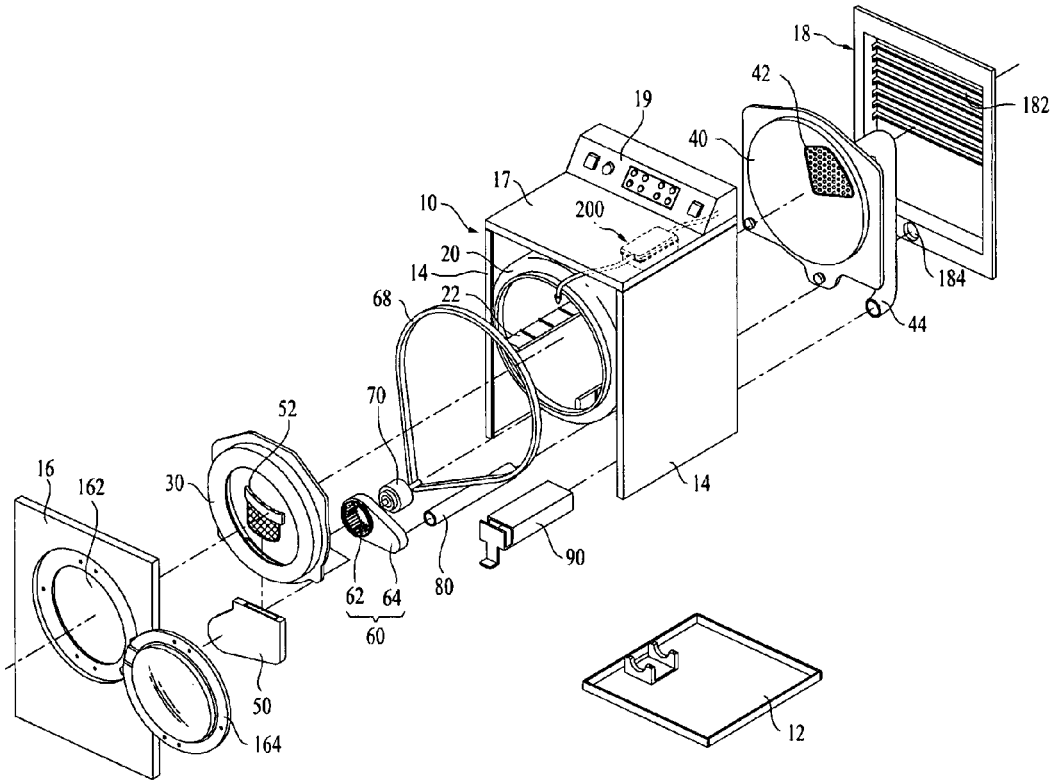
FIG. 1 illustrates an exploded perspective view of a dryer in accordance with a preferred embodiment of the present invention.
Figure 2:
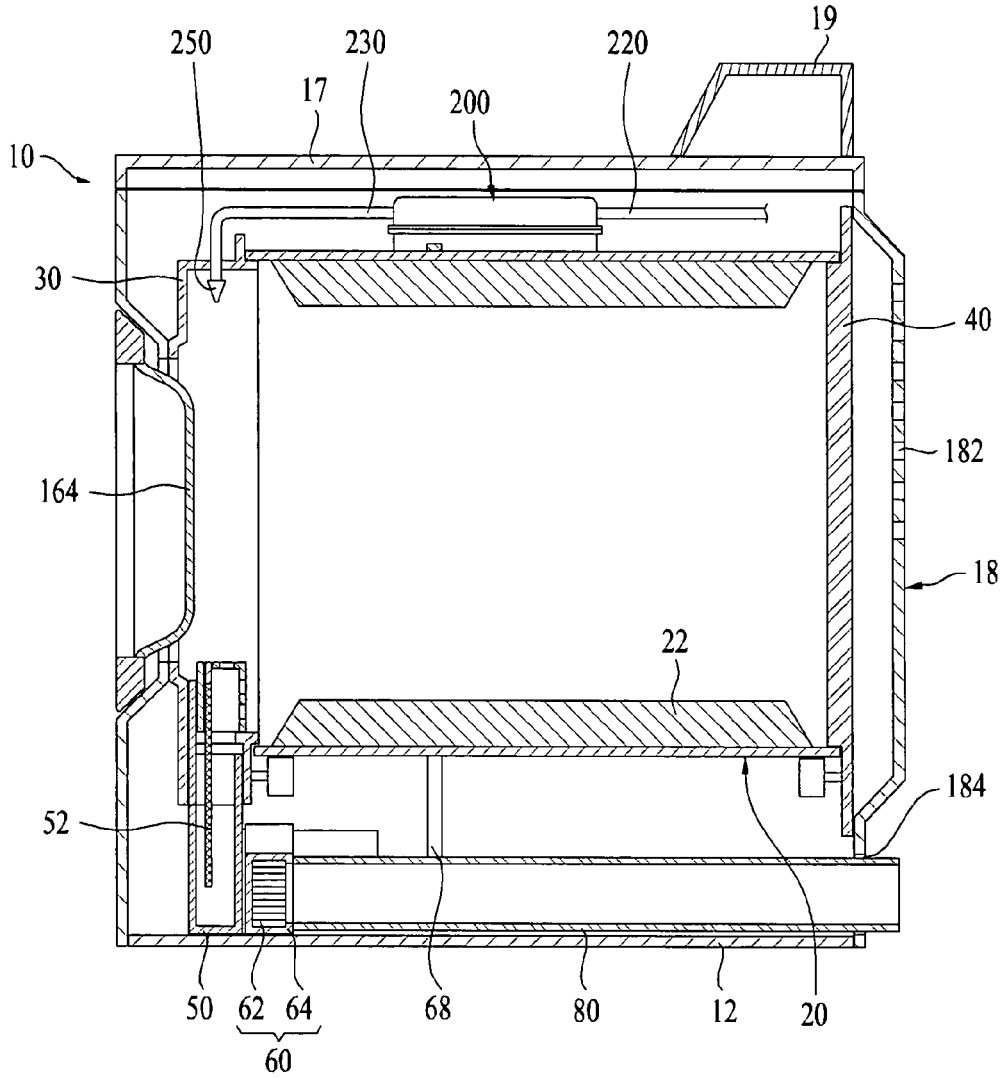
FIG. 2 illustrates a longitudinal section of the dryer in FIG. 1.

A laundry machine and a method for controlling the same in accordance with a preferred embodiment of the present invention will be described with reference to FIGS. 1 and 2.

Inside of a cabinet 10 which forms an exterior of the dryer, there are a rotatable drum 20, a motor 70 and a belt 68 for driving the drum 20. Mounted at a predetermined location of the cabinet 10, there are a heater 90 (will be called as hot air heater) for heating air to produce high temperature air (will be called as hot air), and a hot air supply duct 44 for supplying the hot air from the hot air heater 90 to the drum 20. And, an exhaust duct 80 for discharging humid air heat exchanged with the laundry at the drum 20 and a blower unit 60 for drawing in the humid air are also mounted. In the meantime, mounted at a predetermined location of the cabinet 10, there is a steam generator 200 for generating hot steam. For convenience sake, in the embodiment, though the present invention is shown and described based on an indirect drive type in which the drum 20 is rotated with the motor 70 and the belt 68, the present invention is not limited this, but is also applicable to a direct drive type in which the drum 20 is rotated directly by a motor directly connected to a rear of the drum 20.

Respective elements of the dryer will be described in detail.

The cabinet 10 which forms an exterior of the dryer includes a base 12 which forms a bottom of the dryer, one pair of side covers 14 mounted to the base 12 vertically, a front cover 16 and a rear cover 18 mounted to a front and a rear of the side covers 14 respectively, and a top cover 17 located on top of the side covers 14. A control panel 19 with various operation switches is conventionally located on the top cover 17 or the front cover 16. The rear cover 18 has an inlet 182 for introduction of external air, and an exhaust hole 184 which is a final passage for discharging the air from the drum 20 to an outside of the dryer.

An inside space of the drum 20 serves as a drying chamber for drying the clothes, and, it is preferable that lifts 22 are provided in the drum 20 for lifting and dropping clothes, to turn the clothes upside down for enhancing drying efficiency.

In the meantime, mounted between the drum 20 and the cabinet 10 (the front cover 16 and the rear cover 18), there are a front supporter 30 and a rear supporter 40. Rotatably mounted between the front supporter 30 and the rear supporter 40, there is the drum 20, and mounted between the front supporter 30 and the rear supporter 40 and the drum 20, there are sealing members (not shown) for preventing leakage, respectively. That is, the front supporter 30 and the rear supporter 40 respectively cover the front and rear of the drum 20 to form the drying chamber, and serve to support the front and rear of the drum 20, respectively.

The front supporter 30 has an opening to make the drum 20 to be in communication with an outside of the dryer, and the opening has a door 164 for selective opening/closing. The front supporter 30 has a lint duct 50 connected thereto, which is a passage of the air from the drum 20 to an outside of the dryer, with a lint filter 52 mounted thereto. The blower unit 60 has one side connected to the lint duct 50, and the other side connected to the exhaust duct 80 which is connected to the exhaust hole 184 in the rear cover 18. Accordingly, if the blower unit 60 is operated, the air is discharged to an outside of the dryer from the drum 20 through the lint duct 50, the exhaust duct 80, and the exhaust hole 184. In this instance, foreign matters, such as lint, are filtered at the lint filter 52. In general, the blower unit 60 includes a blower 62 and a blower housing 64, and, in general, the blower 62 is driven by the motor 70 which also drives the drum 20.

The rear supporter 40 has an opening portion 42 having, in general, a plurality of pass through holes, with the hot air supply duct 44 connected thereto. The hot air supply duct 44 is in communication with the drum 20 for serving as a passage for supplying the hot air to the drum 20. Accordingly, the hot air heater 90 is mounted to a predetermined location of the hot air supply duct 44.

Figure 3:
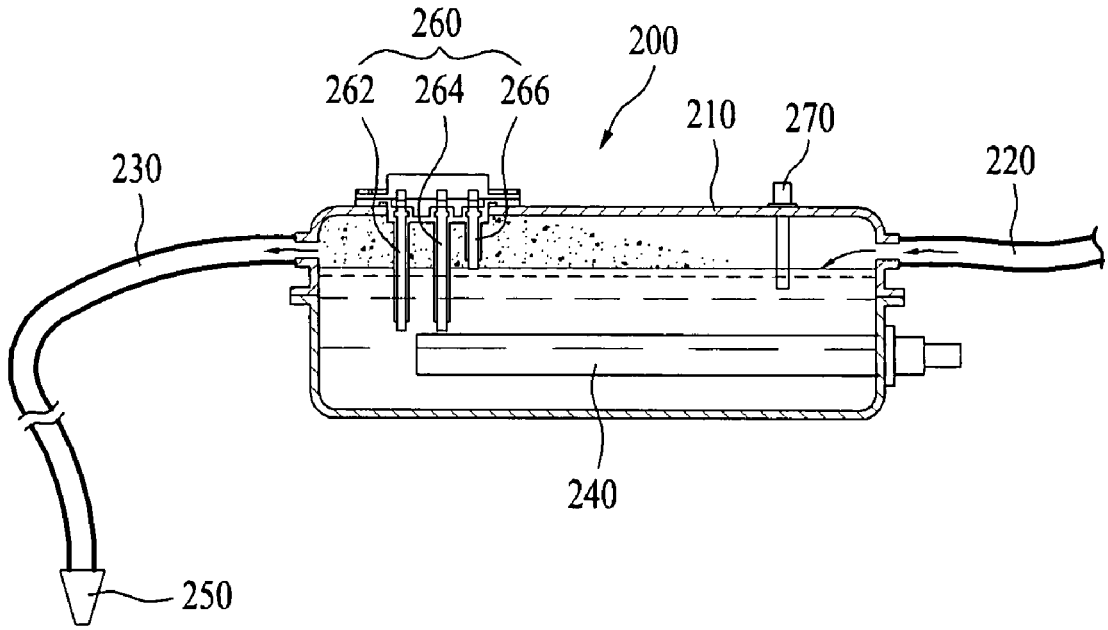
FIG. 3 illustrates a section of a steam generator in FIG. 1.

In the meantime, mounted to a predetermined location of the cabinet 10, there is the steam generator 200 for generating steam and supplying the steam to the drum 20. The steam generator 200 will be described in detail with reference to FIG. 3.

The steam generator 200 includes a water tank 210 for holding water, a heater 240 mounted to an inside of the water tank 210, a water level sensor 260 for measuring a water level of the steam generator 200, and a temperature sensor 270 for measuring a temperature of the steam generator 200. In general, the water level sensor 260 includes a common electrode 262, a low water level electrode 264, and a high water level electrode 266 for sensing a high water level by electric conduction between the common electrode 262 and the high water level electrode 264 or a low water level by electric conduction between the common electrode 262 and the low water level electrode 266.

The steam generator 200 has one side connected to a water supply hose 220 for supplying water, and the other side connected to a steam hose 230 for discharging steam, and it is preferable that a nozzle 250 of predetermined shape is provided to a fore end of the steam hose 230. In general, one end of the water supply hose 220 is connected to an external water supply source, such as tap, and the fore end or the nozzle 250 of the steam hose 230, i.e., a steam outlet is located at a predetermined location of the drum 20, for spraying the steam to an inside of the drum 20.

In the meantime, though the embodiment shows and describes a steam generator 200 (will be called as a tank heating type for convenience sake) in which an amount of water held in the water tank 210 of a predetermined size is heated with the heater 240 to generate the steam, the present invention is not limited to this. That is, the present invention can use any steam generator as far as the device can generate the steam. For an example, a system may also be used, in which a heater may be directly mounted around a water supply hose through which water passes for heating the water without holding the water within a space (for convenience sake, will be called as a tubular heating system).

A dryer in accordance with another preferred embodiment of the present invention will be described with reference to FIG. 4.

In the embodiment, the water supply source for supplying water to the steam generator 200 is detachable.

Similar to the foregoing embodiment, the water supply source may be from the tap, but in this case, equipment becomes complicated.

Because, in general, since the dryer does not use water, if the tap is used as the water supply source, various devices for supplementing the tap is required, additionally.

Therefore, alike in the case of the embodiment, it is very convenient that water is supplied to the detachable water supply source 300 detached from the steam generator 200, and the detachable water supply source 300 having the water filled therein is connected to a water supply passage of the steam generator 200, i.e., the water supply hose 220.

Accordingly, as use of a small sized pump 400 enables mounting of the steam generator 200 without changing the sizes of the components, use of the pump 400 is very favorable.

The remained water is recovered from the steam generator 200 for preventing the heater suffering from damage caused by the water if the steam generator 200 is left unused for a long time, and preventing use of rotten water, later.

Though the foregoing embodiment shows water supply to, and steam discharge from a top side of the steam generator 200, in the embodiment, it is preferable that the water is supplied to an underside of the steam generator 200 and the steam is discharged from the top of the steam generator 200. This configuration is favorable for recovering the remained water from the steam generator 200.

It is preferable that a safety valve 500 is provided to the steam flow passage, i.e., the steam hose 230, which discharges steam from the steam generator 200.

Figure 5:
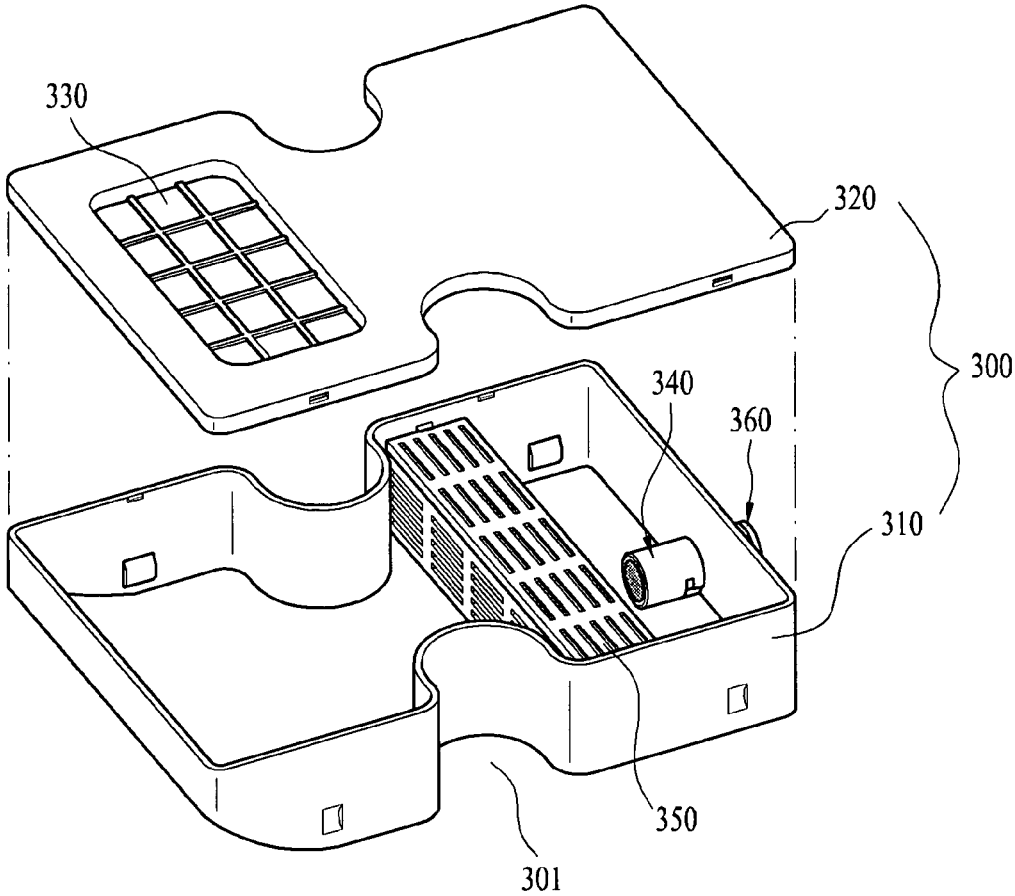
FIG. 5 illustrates an exploded perspective view of an example of the water supply source in FIG. 4.

Referring to FIG. 5, in the embodiment, the detachable water supply source 300 (for convenience sake, will be called as a cartridge) includes a lower housing 310 for holding water actually, and an upper housing 320 detachable from the lower housing 310.

The cartridge 300 with the lower housing 310 and the upper housing 320 enables easy cleaning of fur on an inside of the cartridge 300, and easy disassembly of the filter 330 and 340 and the water softening member 350 for cleaning or regeneration.

A preferred embodiment for mounting elements of a steam line, mainly the steam generator, of the embodiment shown in FIG. 4 will be described with reference to FIG. 6.

It is preferable that a drawable drawer type container (hereafter called as drawer) 700 is mounted to a predetermined location of the dryer, and the cartridge 300 is mounted to the drawer 700. That is, rather than connecting the cartridge 300 to a connection port 480 directly, it is preferable that the cartridge 300 is mounted to the drawer 700, and the drawer 700 is pushed in/pulled out so that the cartridge 300 is connected to/disconnected from the connection port 480, indirectly.

It is preferable that the drawer 700 is provided to the front of the dryer, for an example, to the control panel 19. In detail, a supporter 820 is provided on a rear side of the control panel 19. That is, it is preferable that the supporter 820 is mounted parallel to the top frame 830 substantially, and a drawer guide 710 is mounted to the supporter 820 and the top frame 830 for guiding and supporting the drawer 700, and it is more preferable that a top guide 810 is provided to a portion of an upper portion of the drawer guide 710.

Preferably, the drawer guide 710 has an opening in an upper portion and in one side (on a front side of the dryer), so that the drawer 700 is pushed in/pulled out through the opening in one side, and the connection port 480 is provide to an upper portion of the other side of the drawer guide 710.

As described before, it is preferable that the drawer 700 is mounted to the front of the dryer in view of convenience of use of the dryer. As FIG. 6 illustrates a dryer in which the control panel 19 is mounted to the front cover, the drawer 700 being pushed in/pulled out of the control panel 19 has been described. However, the present invention is not limited to this, but, for an example, if the control panel is mounted to the top cover as shown in FIG. 1, the drawer 700 may be mounted to the front cover, directly.

In the meantime, if the cartridge 300 is placed in the drawer 700, it is preferable that at least shapes of opposite sides of the cartridge 300 are in conformity with shapes of opposite sides of the drawer 700, so that the cartridge 300 is engaged with the drawer 700, closely. It is preferable that recesses 301 are formed in opposite sides of the cartridge 300 for mounting/dismounting of the cartridge 300.

A method for supplying water to the cartridge 300 will be described.

When the user pulls out the drawer 700, the cartridge 300 is also pulled out. In this state, the cartridge 300 is dismounted from the drawer 700, and water is supplied to the cartridge 300 dismounted. The cartridge 300 having the water filled therein is mounted to the drawer 700 again, and then, if the drawer 700 is pushed in, the cartridge 300 and the connection port 480 are connected automatically, providing an opening for the water from the cartridge 300 to the pump 400.

Figure 4:
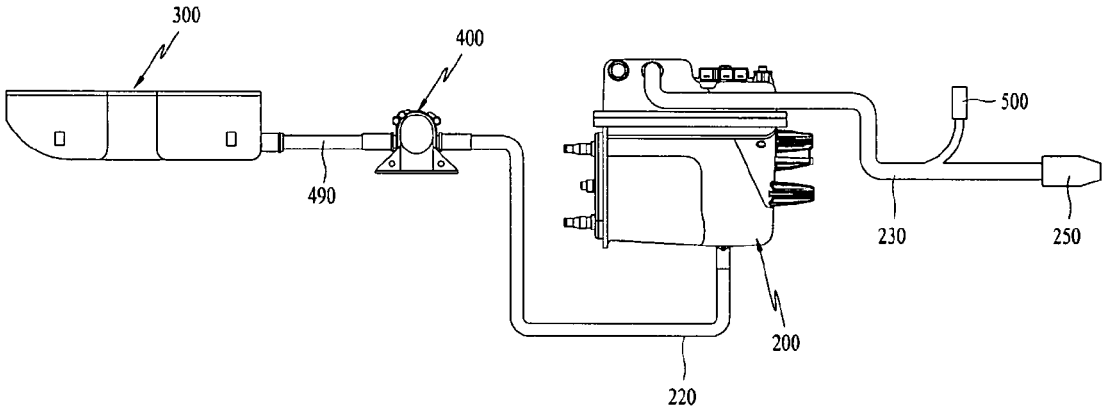
FIG. 4 illustrates a diagram of a dryer in accordance with another preferred embodiment of the present invention focused on the steam generator, schematically.
Figure 6:
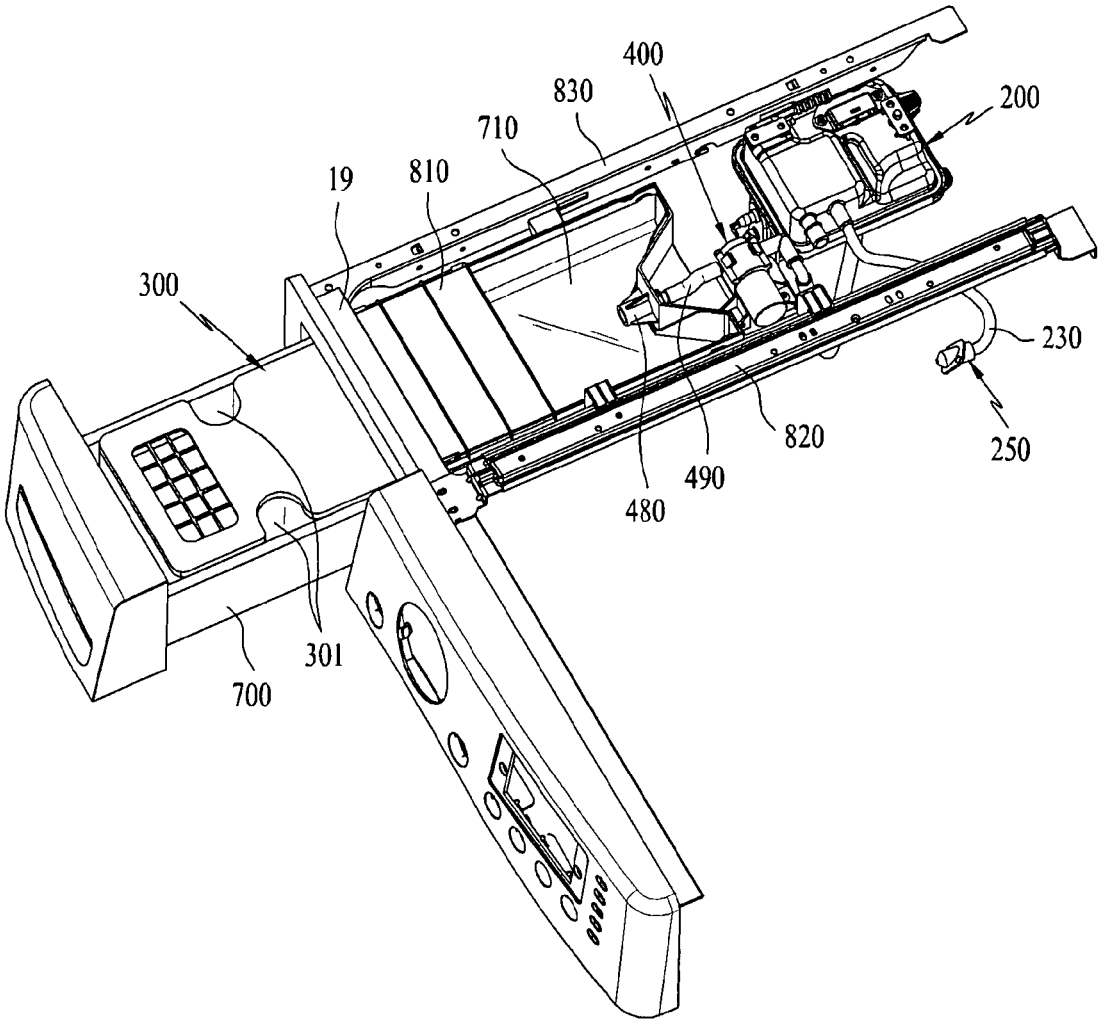
FIG. 6 illustrates a perspective view of a mounting example of elements in FIG. 4.

In the laundry machine having the water supply source 300 shown in FIGS. 4 to 6, if the pump 400 is out of order or the water supply source is not connected properly, the water supply to the steam generator 200 fails, to cause a system fault, such as overheating of the heater 240, or idling of the pump 400.

That is, an object of the present invention lies on preventing a system fault from happening by sensing the pump being out of order or a connection state of the water supply source 300.

The following embodiment is applicable both to a washing machine or a dryer having a steam generator, particularly to a washing machine or a dryer having a detachable water supply source.

Figure 7:
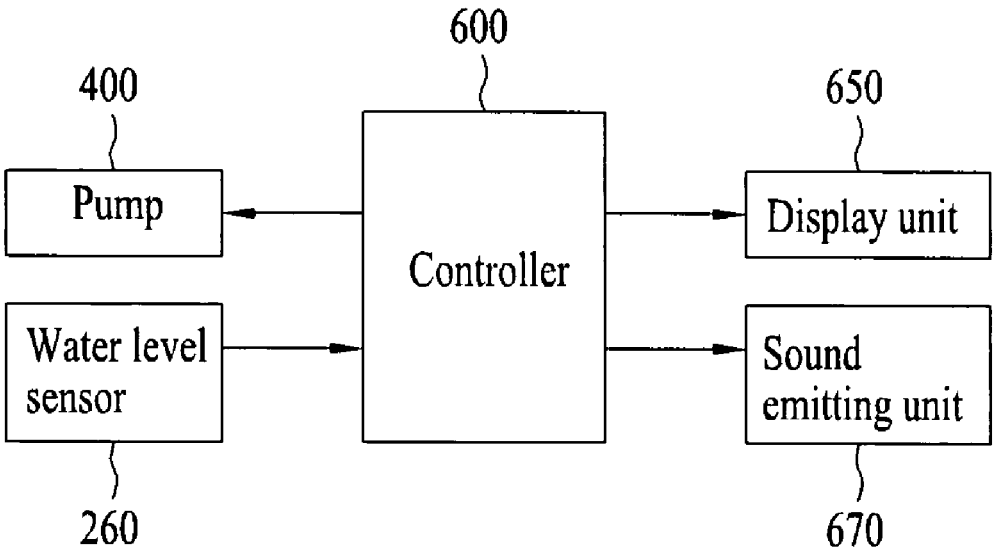
FIG. 7 illustrates a block diagram of a system for sensing a fault of a pump on the steam line in FIG. 4.

Referring to FIG. 7, the embodiment for achieving the object provides a laundry machine including a steam generator 200 for supplying high temperature steam, a detachable water supply source 300 for supplying water to the steam generator 200, a pump 400 for guiding water from the water supply source 300 to the steam generator 200, and controller 600 for determining the pump 400 being out of order by using a time period required for supplying water to a preset water level at the time of water supply to the steam generator 200.

The controller 600 of the embodiment keeps sensing the water level with the water level sensor 260 in the steam generator 200. In this instance, the controller 600 counts a time period in which the water level of the steam generator 200 is required to reach from a low water level electrode 264 to a high water level electrode 266, to determine the pump 400 being out of order according to the time period required for supply the water.

Moreover, the laundry machine further includes a display unit 650 for displaying a fault state for the user to notice the fault state if a fault of the pump 400 is sensed under the control of the controller 600, and a sound emitting unit 670 for emitting the fault state with voice or a buzzer.

The steps of sensing the pump 400 being out of order will be described.

Figure 8:
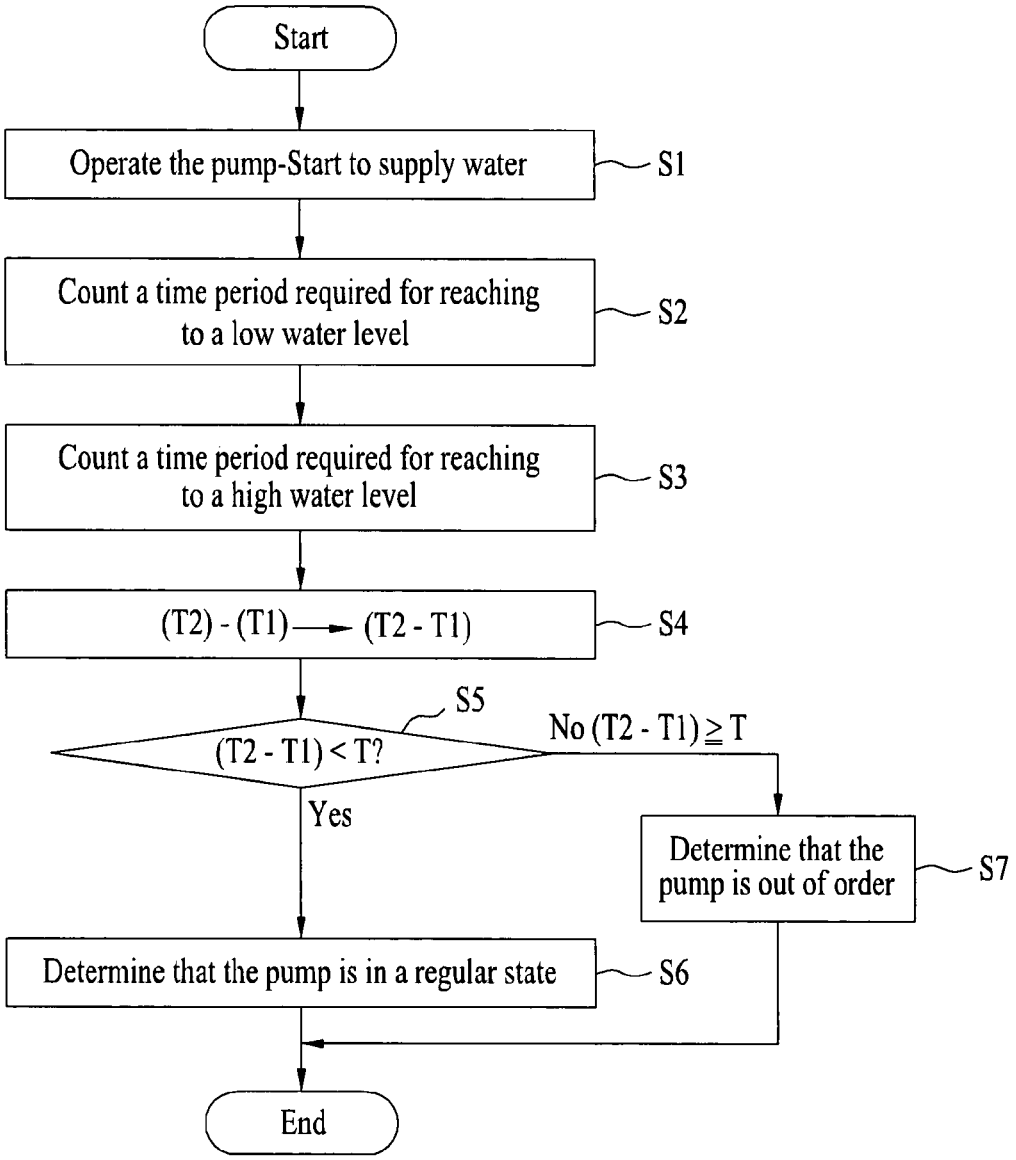
FIG. 8 illustrates a flow chart of the steps of a method for sensing a fault of a pump in the system in FIG. 7.

Referring to FIG. 8, if steam generation is required, the pump 400 is put into operation for supplying water from the water supply source 300 to the water tank 210 in the steam generator 200 (S1).

In this instance, the controller 600 counts a first time period T1 in which the water level of the water tank 210 reaches to the low water level electrode 264 owing to the water supply and memories the count (S2).

Then, the controller 600 counts a second time period T2 in which the water level of the water tank 210 reaches to the high water level electrode 266 as the water supply is kept on and memories the count (S3).

By subtracting the first time period T1 from the second time period T2 at the time point when the water level of the water tank 210 reaches to the high water level electrode 166, the controller 600 can calculate a water supply time period (T2−T1) required for the water level to reach from the low water level electrode 264 to the high water level electrode 266 (S4).

Moreover, in another method for calculating the water supply time period (T2−T1), the controller 600 counts a time period starting from a time point when the water level of the water tank 210 reaches to the low water level electrode 264. Then, the controller 600 keeps counting the time period until the water level reaches to the high water level electrode 266, to obtain a time period counted up to a time point when the water level reaches to the high water level electrode 266 and recognize the time period as the water supply time period (T2−T1).

Thus, fault of the pump 400 is determined by using the water supply time period (T2−T1). If the pump 400 is out of order, failing regular supply of water to the steam generator 200, the water supply time period (T2−T1) passes a preset time period. The preset time period varies with a capacity of the water tank 210 and a height difference of the low water level and high water level electrodes 264 and 266, and can be determined by repetitive experiments under the same environment.

If the water supply time period (T2−T1) is less than the preset time period, i.e., if the water level of the water tank 210 reaches from the low water level to the high water level within the preset time period, the pump 400 is determined being in order (S5, and S6).

Opposite to this, if the water supply time period (T2−T1) is taken more than the preset time period, the controller 600 determines that the pump 400 is out of order, i.e., abnormal (S5, and S7).

If it is sensed that the pump is out of order in the step S7, it is preferable that both the pump 400 and the steam generator are stopped.

Figure 9:
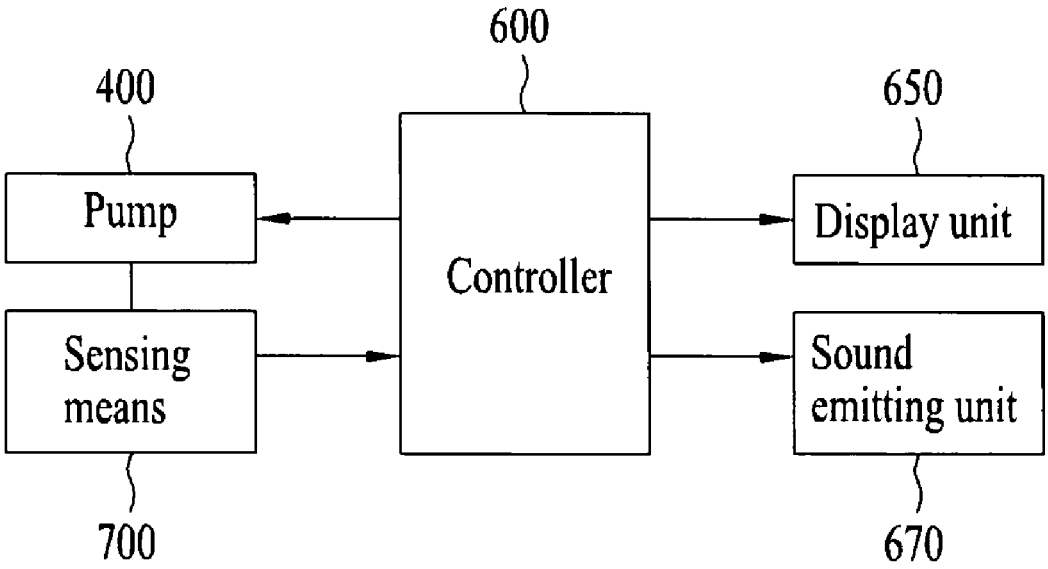
FIG. 9 illustrates a block diagram of another system for sensing a fault of a pump on the steam line in FIG. 4.

Referring to FIG. 9, as another embodiment, a laundry machine is provided, including a steam generator 200 for supplying high temperature steam, a detachable water supply source 300 for supplying water to the steam generator 200, a pump 400 for guiding water from the water supply source 300 to the steam generator 200, sensing means 700 for sensing a current from the pump 400, and controller 600 for determining the pump 400 being out of order by using a current level of the pump 400 sensed at the sensing means 700.

As the sensing means 700 for sensing the current level of the pump 400, a circuit with a CT (current transducer) or a shunt resistor is used.

Figure 10:
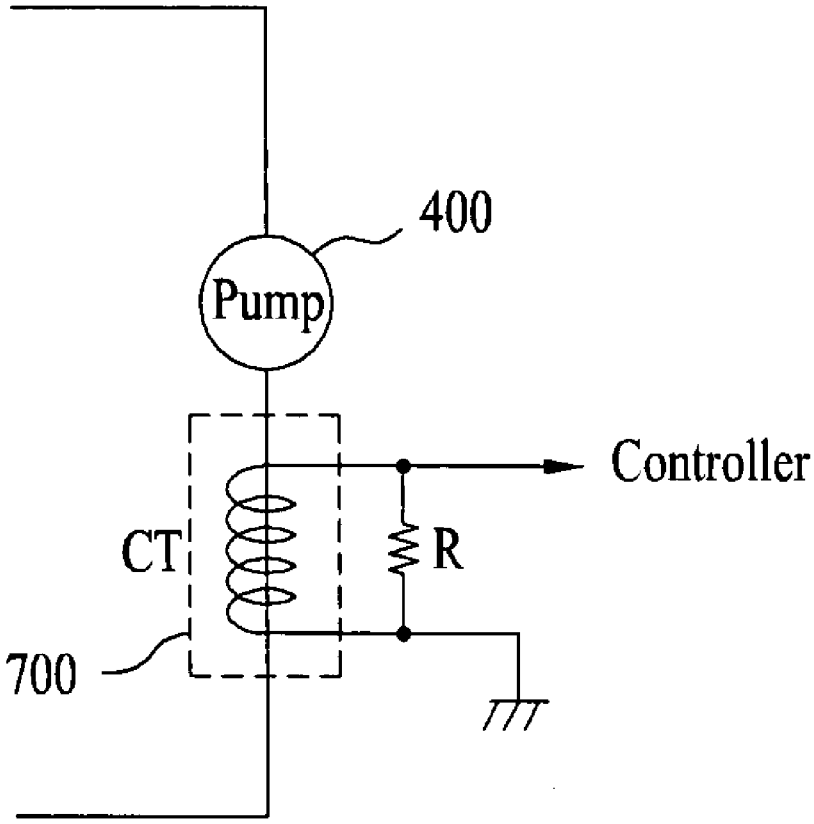
FIG. 10 illustrates a circuit of pump fault sensing means in FIG. 9 in accordance with a first preferred embodiment of the present invention.

Referring to FIG. 10, the CT is mounted to one end of the pump 400, and the resistor R is connected parallel to the CT. In this instance, the CT is made to form a magnetic field by the current to the pump 400, and provides a voltage proportional to the magnetic field formed thus. It is preferable that the shunt resistor R is connected in parallel to the CT to drop the voltage from the CT to a voltage level which can be sensed by the controller.

The CT is applicable when the pump 400 has an AC motor, does not affect to the torque of the pump 400 at all, and causes little noise because an output terminal of the CT is insulated.

Figure 11:
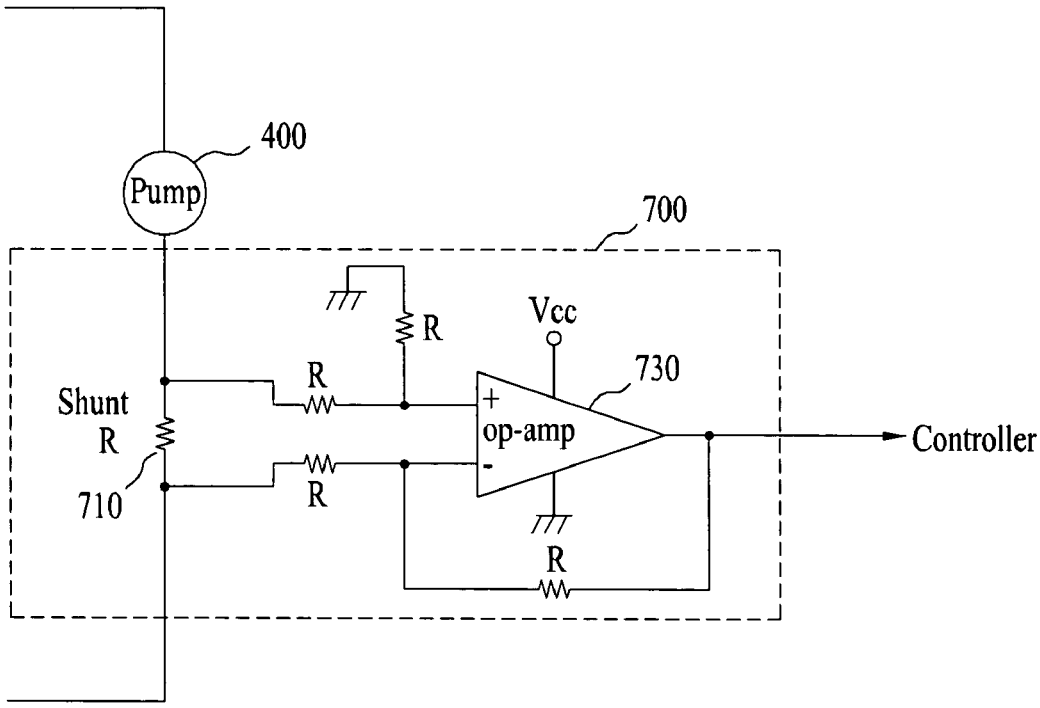
FIG. 11 illustrates a circuit of pump fault sensing means in FIG. 9 in accordance with a second preferred embodiment of the present invention.

In the meantime, referring to FIG. 11, the sensing means 700 may include a shunt resistor 710 connected to the pump 400 in series, and an OP-AMP 730 for amplifying an output from the shunt resistor 710. The shunt resistor 710 outputs a voltage corresponding to a current level to the pump 400, and the voltage from the shunt resistor 710 is amplified with the OP-AMP 730, and provided to the controller 600.

The circuit with the OP-AMP 730, a difference amplifier, for amplifying a voltage difference between opposite ends of the shunt resistor 710 to a level at which the controller 600 can sense the voltage difference.

The sensing means 700 with the shunt resistor 710 is applicable to the pump 400 with a DC motor This circuit may save cost as the shunt resistor 710 circuit is more reliable than the CT.

The controller 600 of the embodiment can determine the current level of the pump 400 with reference to the voltage sensed at the sensing means 700 in FIGS. 10 and 11. For an example, by writing up a current table for various voltages with data obtained by repetitive experiments in the same environment, and storing the table in the controller 600, and reading a current level on the table stored thus for a voltage from the sensing means 700, the current level of the pump 400 can be determined.

That is, in the embodiment, with reference to the current level of the pump 400, fault of the pump 400 or a state of water shortage at the water supply source can be determined.

The embodiment can also inform a fault state, such as the fault of the pump 400, or the state of water shortage, to the user through the display unit 650 or the sound emitting unit 670.

The steps of a method for sensing a fault of the embodiment will be described in detail.

Figure 12:
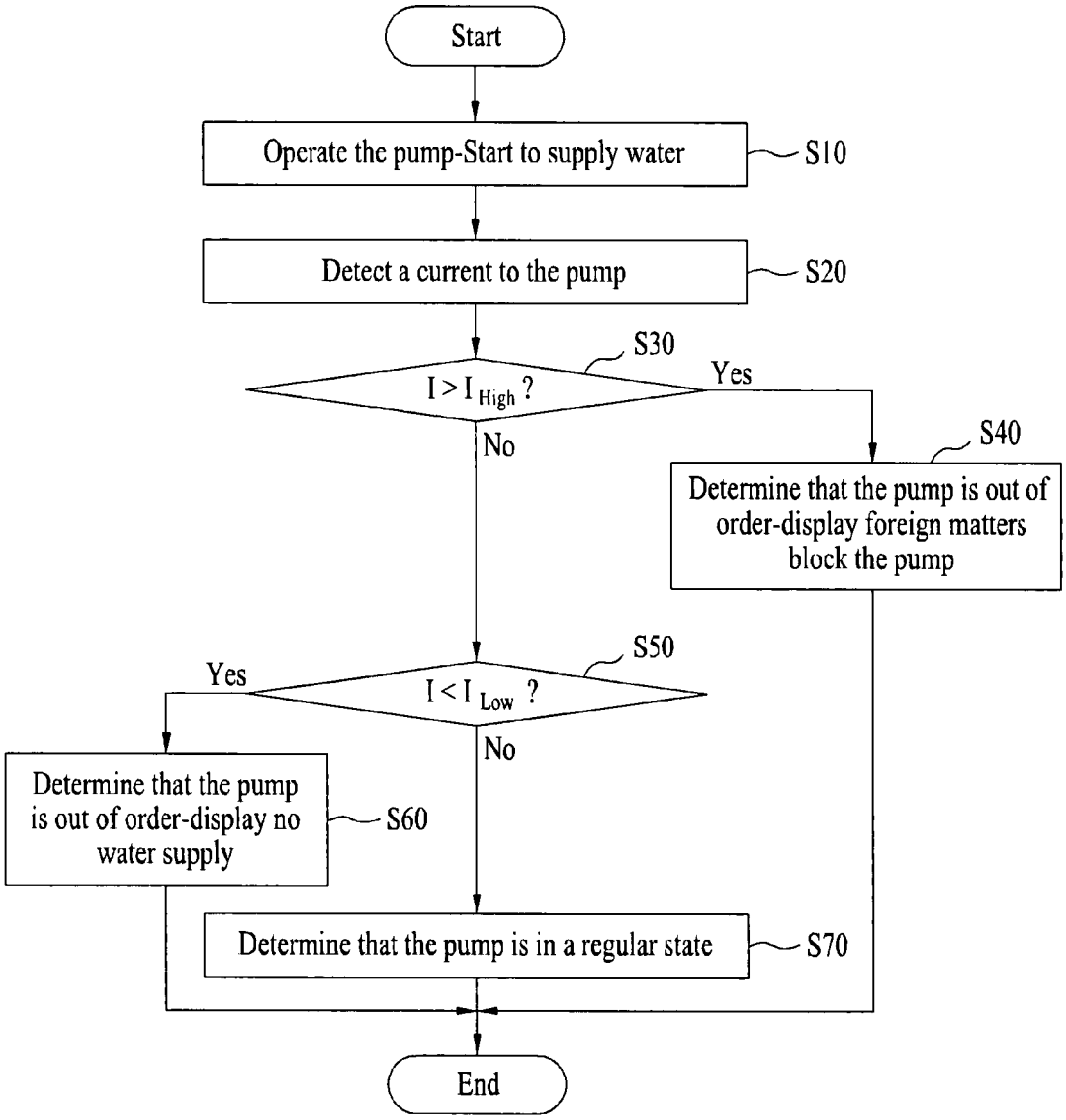
FIG. 12 illustrates a flow chart of the steps of a method for sensing a fault of a pump in the system in FIG. 9.

Referring to FIG. 12, when the steam starts to generate, the pump 400 is put into operation to supply water from the water supply source 300 to the steam generator 200 (S10).

The current levels of the pump are read at least two times at regular intervals for a preset time period after the starting of pump 400. An average of the current levels read for many times during the preset time period is calculated, and the average is determined to be as a current level I of the pump (S20).

For an example, the current levels of the pump 400 sensed at the sensing means 700 are read at 0.1 seconds intervals for one second, and the average of the current levels read for 10 times is calculated.

If the current level I of the pump 400 exceeds a preset highest value $I_{HIGH}$ with a normal range, it is determined that the pump 400 is overloaded due to foreign matters blocking the pump 400 (S30, S40).

Opposite to this, if the current level I of the pump 400 is below a preset lowest value $I_{LOW}$ within the normal range, it is determined that the pump 400 is in an idling state, i.e., a state no water supply is being made (S50, S60).

In the meantime, if the current level I of the pump 400 is within the normal range, it is determined that not only the water supply, but also the pump 400 is normal (S70).

It is preferable that operation of the pump 400 and the steam generator 200 is stopped if the foreign matter blocking state or the no water supply state is determined in the steps of S40 and the S60.

If it is determined that the pump 400 is out of order in the embodiments of FIGS. 8 and 12, error messages indicating faults of the pump, such as pump fault, blocking of foreign matters at the pump, and no water supply, can be displayed on the display unit 650.

Moreover, a message or buzzer indicating pump fault may be sound from the sound emitting unit 670.

That is, in order to give notice to the user of the pump 400 fault, and the stopping of operation of the steam generator 200 adequately, the display unit 650 or the sound emitting unit is used.

Eventually, the present invention senses a fault state of the pump that guides the water from the water supply source to the steam generator, to determine a system performance.

In order to protect the system at the time point the pump fault is sensed, the operation of the system is stopped forcibly, and a fault state of the product is informed to the user, positively.

The laundry machine and the method for controlling the same of the present invention have the following advantages.

First, the laundry machine with the steam generator can prevent creases from forming on a drying object and effectively sterilize the drying object.

Second, the laundry machine with a detachable water supply source checks a time period required for supplying of water to the steam generator, or a pump current to sense a fault state of a steam generating line to increase product safety.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A laundry machine comprising:

a water supply source configured to be filled with water by a user;

a selectively rotatable drum;

a steam generator to generate steam to be supplied to the drum;

a pump to supply water from the water supply source to the steam generator; and a controller to determine whether the pump is out of order by using a time period required for supplying water to a preset water level of the steam generator.

2. The laundry machine of claim 1, wherein the steam generator includes;

a water tank to hold the water, and a water sensor having a low water level electrode and a high water level electrode for sensing a low water level in the water tank with the low water level electrode and a high water level in the water tank with the high water level electrode.

3. The laundry machine of claim 2, wherein the controller counts a time period in which the water level in the water tank sensed with the water level sensor is required to reach from the low water level to the high water level, and determining whether the pump is out of order based on the counted time period required for supplying water.

4. The laundry machine of claim 1, further comprising a display to indicate to a user that the pump is out of order.

5. The laundry machine of claim 1, wherein the water supply source is detachable from the water supply path.

6. The laundry machine of claim 5, further comprising a drawer type container separably provided in a predetermined portion of a cabinet.

7. The laundry machine of claim 6, wherein the water supply source is detachable from the drawer type container.

8. The laundry machine of claim 1, further comprises a water supply path between the steam generator and the water supply source.

9. The laundry machine of claim 8, wherein the water supply source is detachable from the water supply path.

10. The laundry machine of claim 9, further comprising a drawer type container separably provided in a predetermined portion of a cabinet.

11. The laundry machine of claim 10, wherein the water supply source is detachable from the drawer type container.

12. A laundry machine comprising:

a water supply source to be filled with water by a user;

a selectively rotatable drum;

a steam generator to generate steam to be supply to the drum;

a water supply path between the steam generator and the water supply source;

a pump to supply water from the water supply source to the steam generator; and a controller to determine whether the pump is out of order by using a time period required for supplying water to a preset water level of the steam generator, wherein the out of order of the pump includes a blockage of the pump and an insufficiency of water in the water supply source.

13. The laundry machine of claim 12, wherein the water supply source is detachable from the water supply path.

14. The laundry machine of claim 13, wherein the water supply source is detachable from the drawer type container.

15. The laundry machine of claim 14, wherein the controller counts a time period in which the water level in the water tank sensed with the water level sensor is required to reach from the low water level to the high water level, and determining whether the pump is out of order based on the counted time period required for supplying water.

16. The laundry machine of claim 12, further comprising a drawer type container separably provided in a predetermined portion of a cabinet.

17. The laundry machine of claim 12, wherein the steam generator includes;

a water tank to hold the water, and a water sensor having a low water level electrode and a high water level electrode for sensing a low water level in the water tank with the low water level electrode and a high water level in the water tank with the high water level electrode.

18. The laundry machine of claim 12, further comprising a display to indicate to a user that the pump is out of order.

* * * * *